US009198519B2

(12) United States Patent
Katoh et al.

(10) Patent No.: US 9,198,519 B2
(45) Date of Patent: Dec. 1, 2015

(54) MATTRESS AND BED DEVICE

(71) Applicant: PARAMOUNT BED CO., LTD., Tokyo (JP)

(72) Inventors: Atsushi Katoh, Tokyo (JP); Kenta Ohno, Tokyo (JP)

(73) Assignee: PARAMOUNT BED CO., LTD., Tokyo (JP)

( * ) Notice: Subject to any disclaimer, the term of this patent is extended or adjusted under 35 U.S.C. 154(b) by 0 days.

(21) Appl. No.: 14/359,051

(22) PCT Filed: Nov. 13, 2012

(86) PCT No.: PCT/JP2012/079330
§ 371 (c)(1),
(2) Date: May 16, 2014

(87) PCT Pub. No.: WO2013/073511
PCT Pub. Date: May 23, 2013

(65) Prior Publication Data

US 2015/0082543 A1 Mar. 26, 2015

(30) Foreign Application Priority Data

Nov. 17, 2011 (JP) ..... 2011-251896

(51) Int. Cl.
*A61G 7/002* (2006.01)
*A47C 27/14* (2006.01)
(Continued)

(52) U.S. Cl.
CPC ..... *A47C 19/04* (2013.01); *A47C 27/142* (2013.01); *A47C 27/144* (2013.01); *A47C 27/146* (2013.01); *A61G 7/05723* (2013.01); *A61G 7/015* (2013.01); *A61G 7/0755* (2013.01)

(58) Field of Classification Search
CPC ..... A47C 19/04; A47C 21/042; A61G 7/0573
USPC ..... 5/181, 184, 624, 652.1, 724, 730, 740
See application file for complete search history.

(56) References Cited

U.S. PATENT DOCUMENTS 4,777,681 A 10/1988 Luck et al.
5,705,252 A 1/1998 Lea et al.
(Continued)

FOREIGN PATENT DOCUMENTS

JP 2006-136669 A 6/2006
JP 2009-226088 A 10/2009
(Continued)

OTHER PUBLICATIONS

European Search Report, dated Jul. 17, 2015, issued in European Patent Application No. 12850390.1.

*Primary Examiner* — Michael Trettel
(74) *Attorney, Agent, or Firm* — Birch, Stewart, Kolasch & Birch, LLP

(57) ABSTRACT

In order to provide a mattress that has punched holes of the same number and the same area as conventional products, is easy to contract thanks to efficient application of shearing stress to the punched holes of the mattress without the need of corrugation forming, and will neither deteriorate in strength nor increase the number of processing steps compared to conventional products, as well as a bed device using the mattress, a mattress 10 has such a structure that the (core of) foot section 18 is formed with a plurality of linear shaped holes 28 that are penetrated at regular intervals in the thickness direction of the foot section with the orientation of the linear-shape inclined relative to the width direction of mattress 10, and the plurality of holes 28 are arranged in the mattress 10 in a staggered layout when viewed from top.

11 Claims, 9 Drawing Sheets

(51) Int. Cl.

| | |
|---|---|
| ***A47C 19/04*** | (2006.01) |
| ***A61G 7/057*** | (2006.01) |
| *A61G 7/015* | (2006.01) |
| *A61G 7/075* | (2006.01) |

(56) References Cited

U.S. PATENT DOCUMENTS

| | | | | |
|---|---|---|---|---|
| 7,743,441 | B2 * | 6/2010 | Poulos et al. | 5/618 |
| 8,495,774 | B2 * | 7/2013 | Soltani | 5/618 |
| 2005/0172405 | A1 * | 8/2005 | Menkedick et al. | 5/618 |
| 2006/0021142 | A1 * | 2/2006 | Hornbach et al. | 5/600 |
| 2006/0059624 | A1 | 3/2006 | Poulos et al. | |
| 2010/0330330 | A1 | 12/2010 | Luca et al. | |

FOREIGN PATENT DOCUMENTS

| | | | |
|---|---|---|---|
| JP | 2009-273894 | A | 11/2009 |
| JP | 2011-512880 | A | 4/2011 |
| WO | WO 2009/089077 | A2 | 7/2009 |

* cited by examiner (a)

(b)

(a)

(b)

(a)

(b)

MATTRESS AND BED DEVICE

TECHNICAL FIELD

The present invention relates to a mattress and a bed device.

BACKGROUND ART

Conventionally, there have been proposals of technologies for bed devices whose legs are adjustable in length.

For example, Japanese Patent Application Laid-open 2006-136669 (which will be referred to hereinbelow as "Patent Document 1") discloses a mattress that is adjustable in bottom length by making the foot-side part of the mattress expandable and contractible in the longitudinal direction of the bed device. In this Patent Document 1, the mattress put on the bottom of the bed is formed of a monolayer urethane foam core in which, in order to adjust the degree of repulsion in the foot side part, cross-shaped or linear shaped through-holes are punched in the thickness direction at regular intervals in a staggered layout.

On the other hand, Japanese Patent Application Laid-open 2009-273894 (which will be referred to hereinbelow as "Patent Document 2") discloses a configuration in which, as shown in the drawings, the foam core of the mattress is formed with corrugation in the foot section. In this case, the corrugation of the foam core allows the foot section to diminish in length when the foot section of the deck is contracted in length.

PRIOR ART DOCUMENTS

Patent Documents

Patent Document 1:
Japanese Patent Application Laid-open 2006-136669
Patent Document 2:
Japanese Patent Application Laid-open 2009-273894

SUMMARY OF THE INVENTION

Problems to be Solved by the Invention

In a case where cross-shaped or linear shaped through-holes are punched at regular intervals in a staggered layout in order to adjust the contractibility of the foot section of the mattress core as in the aforementioned Patent Document 1, a mattress P1 shown in FIG. 10 (*a*) may be formed, for example. However, as shown in (b) in the same figure, the mattress may be hindered to contract properly because the side parts H1, H1 of punched hole H cannot be compressed.

Further, when, corresponding to the aforementioned Patent Document 2, a mattress core P2 is formed in a corrugated manner, for example as shown in FIG. 10(*c*), the heels and part of the body may sink into the grooves V of the corrugation and hit the bottom.

Moreover, to form corrugation, the mattress core itself becomes thin so that there is a risk that the strength of the mattress deteriorates.

Still, when the foot fits in the groove of the corrugation, the force that should contract the mattress acts on the foot so that there is a fear that the contraction of the mattress is hindered.

In view of the above circumstances, the object of the present invention is to provide a mattress that has the same number punched holes of the same area as that of conventional products, is easy to contract thanks to efficient application of shearing stress to the punched holes of the mattress without the need of corrugation forming, and that will neither deteriorate in strength nor increase the number of processing steps compared to conventional products, as well as providing a bed device using the mattress.

Means for Solving the Problems

The present invention resides in a mattress adapted to receive compression at one end in the longitudinal direction, comprising: a plurality of holes including a linear shape inclined relative to a width direction of the mattress, and the holes are penetratingly formed at regular intervals in a section to be deformed by the compression.

In the present invention it is also preferable that the plurality of holes are arranged in the mattress in a staggered layout when viewed from top.

In the present invention it is also preferable that the plurality of holes are formed such that an orientation of the linear shape is inclined at an angle of 20° to 70° relative to the width direction of the mattress.

In the present invention it is also preferable that the plurality of holes including the linear shape are formed as a cross shape.

In the present invention it is also preferable that the plurality of holes are formed with the cross shape inclined at an angle of 20° to 70° relative to the width direction of mattress.

In the present invention it is also preferable that the plurality of holes are formed to a dumbbell-like shape such that the ends of the linear shape are wider than a center.

In the present invention it is also preferable that the plurality of holes are formed such that an orientation of the shape is inclined at an angle of 20° to 70° relative to the width direction of the mattress.

The present invention resides in a bed device having a bottom raising and lowering function or an expandable and contractible function, on which the mattress according to any one of the above is set.

Advantages of the Invention

According to the mattress of the present invention, since the plurality of holes including the linear shape inclined relative to the width direction of the mattress are penetrated through the portion to be deformed by compression, and formed at regular intervals, the mattress is easily contacted thanks to efficient application of shearing stress to the punched holes of the mattress.

In addition, since without the necessity of forming the punched holes in corrugation it is possible to provide an easy-to-use mattress that can prevent the feet from getting stuck, and since the mattress can be formed with punched holes of the same number and the same area as the conventional configuration, it is possible to produce such excellent advantages to provide a mattress that will neither increase the number of processing steps nor deteriorate in strength compared to the conventional configuration.

MODE FOR CARRYING OUT THE INVENTION

Next, the embodiments of the present invention will be described with reference to the accompanying drawings.

FIGS. 1 to 9 are illustrative diagrams of mattresses according to the embodiments of the present invention.

Figure 1:
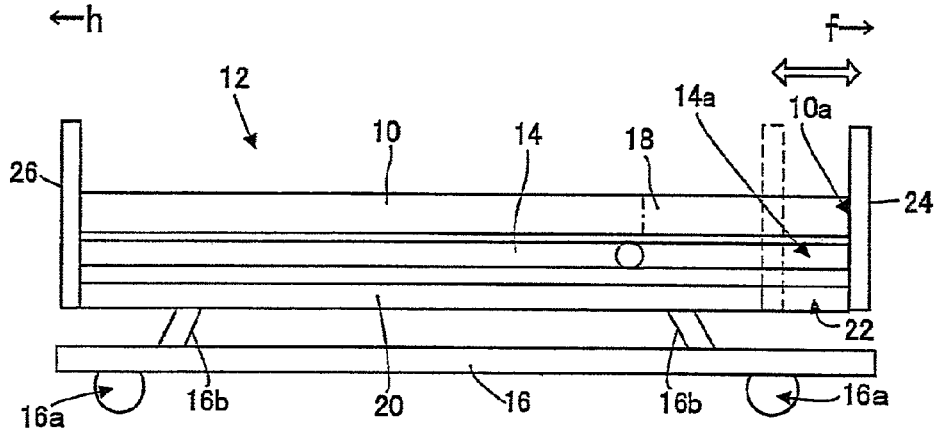
FIG. 1 An illustrative diagram showing a bed device having a mattress according to the embodiment of the present invention, set thereon and having a bottom raising and lowering function and an expandable and contractible function, (a) a side view and (b) a plan view.
Figure 1:
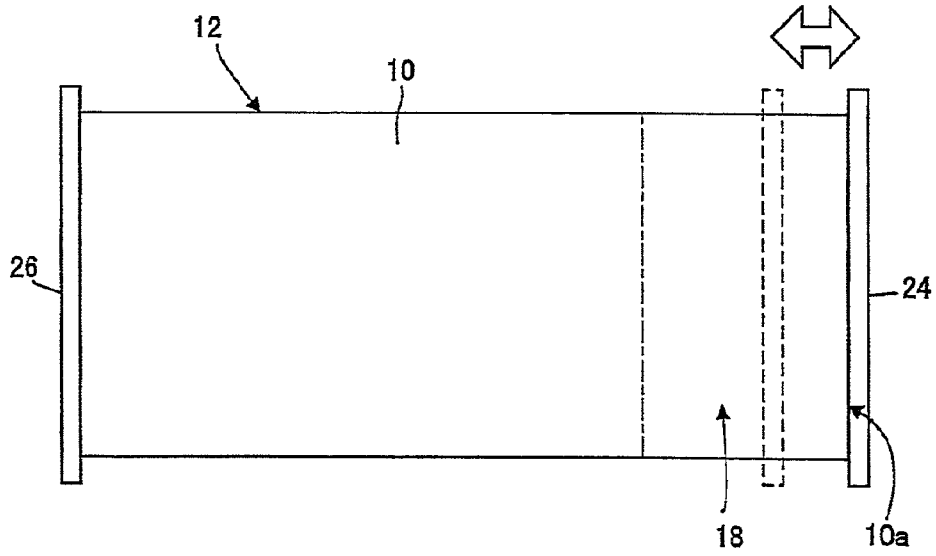
Figure 2:
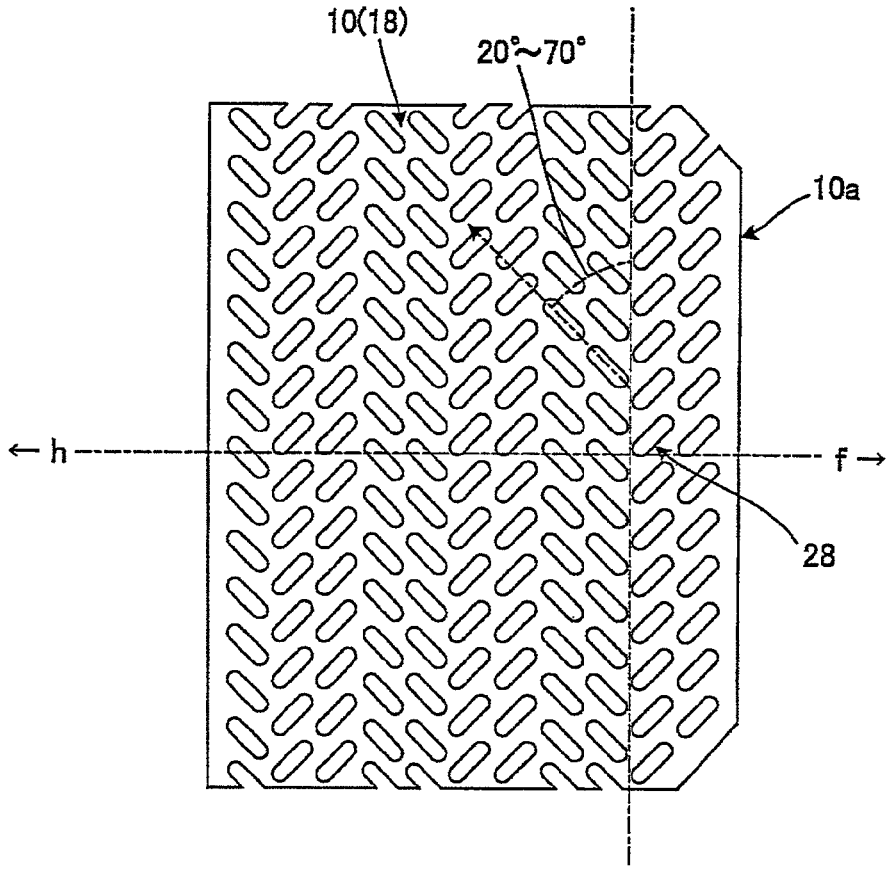
FIG. 2 A plan view of the part (foot section) where the mattress of FIG. 1 deforms.

As shown in FIGS. 1 to 2, a mattress 10 is placed and used on a bottom 14 of a bed device 12. The bed device 12 is installed horizontally at a use place such as hospital, house or the like so that the user such as a patient lies on mattress 10. In FIG. 1, the longitudinal direction of mattress 10 is shown in the lateral direction and the head side which the head of the user lying on mattress 10 faces is denoted with a symbol 'h' as an abbreviation of 'head' while the foot side 18 which the feet of the user faces is denoted with a symbol 'f' as an abbreviation of 'foot'. The orientation indicated by these symbols 'h' and f' is the longitudinal direction of mattress 10.

The bed device 12 has a configuration including an approximately rectangular truck part 16 that is movably set on the usual horizontal floor by means of casters 16*a*, a main frame 20 that is supported so as to be elevatable by means of elevating legs 16*b* on the truck part 16, and the aforementioned bottom 14 supported on the main frame 20.

In one longitudinal end of the main frame 20, namely in the foot side end, an expandable frame 22 is mounted so that it can be expanded and retracted in the longitudinal direction. This expandable frame 22 is formed in its distal end with an upright foot board 24 to which the user's feet should be oriented. In the head side end of main frame 20, a head board 26 is arranged upright. Expandable frame 22 expands and retracts from main frame 20, manually or by means of a power source such as an actuator, at the same time foot board 24 also expands and retracts.

The bottom 14 is formed with an expandable bottom 14*a* that extends from the foot side of bottom 14 so as to cover the top of the expandable frame 22 when the expandable frame 22 is stretched. This expandable bottom 14*a* expands and retracts following the expansion and retraction of expandable frame 22 so as to keep mattress 10 from falling to the expandable frame 22 side. Here, foot board 24 also moves following the expansion and retraction of this expandable bottom 14*a*.

In this way, foot board 24 is arranged upright, and when expandable frame 22 moves forward and backward relative to main frame 20, the length of bottom 14 extends and contracts while foot board 24 moves in the longitudinal direction. Since mattress 10 is prepared so as to fit in with the condition when bottom 14 is stretched to the longest, the mattress 10 is pressed on the longitudinal end 10*a* by foot board 24 as bottom 14 is moved in the contracting direction, and the foot section, designated at 18, is used to receive compression.

In the mattress 10 of the embodiment, the foot section 18 (the portion where the user's feet rest on, and occupying, for example about ½ to ⅕ of the full length of mattress 10) located on the f-direction side, forms the portion that is deformed or compressed by the pressing and the like of the longitudinal end (foot side end) 10*a*. Mattress 10 is formed such that, at least, the foot section 18 is made of a single or plural layers of foamed urethane boards, the mattress 10 as a whole, inclusive of the foot section 18, being enfolded with a cover.

The (core of) foot section 18 is formed with a plurality of linear shaped holes 28 penetrated through the thickness of the foot section 18 at regular intervals with the orientation of the linearly shaped holes inclined relative to the width direction of mattress 10, as shown in FIG. 2.

Further, the plurality of holes 28 are arranged in the mattress 10 in a staggered layout when viewed from top.

The plurality of holes 28 may be formed such that the orientation of the linear shape is inclined at angle of 20° to 70° relative to the width direction of mattress 10. In the embodiment, the plurality of holes 28 are inclined at an angle of 45° relative to the width direction of mattress 10.

[Reason for Forming Holes 28 Inclined Relative to the Width Direction of Mattress 10]

Figure 3:
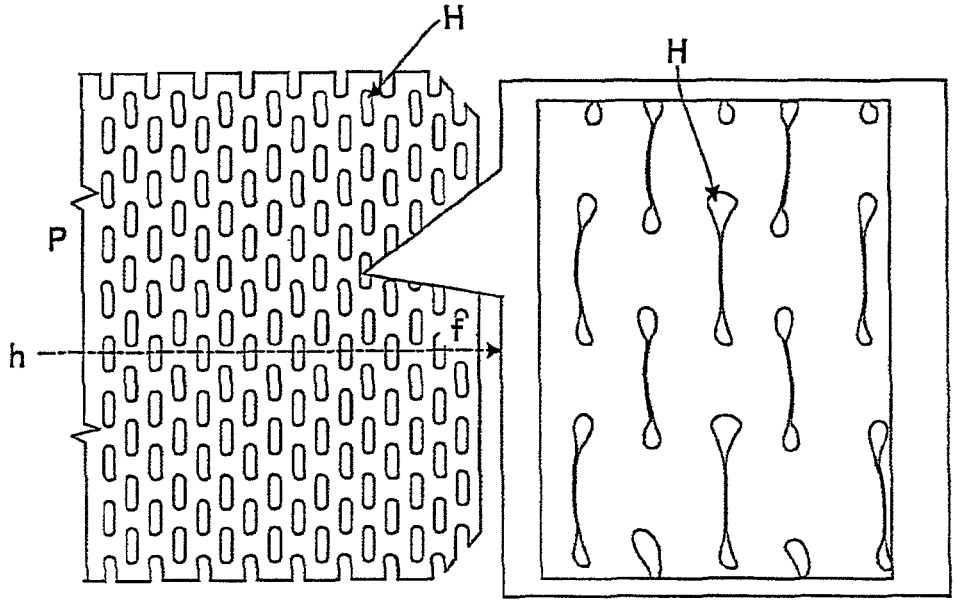
FIGS. 3 (*a*) and (*b*) illustrative diagrams comparatively showing deformation of holes of mattresses between a conventional configuration and a configuration according to the embodiment.
Figure 3:
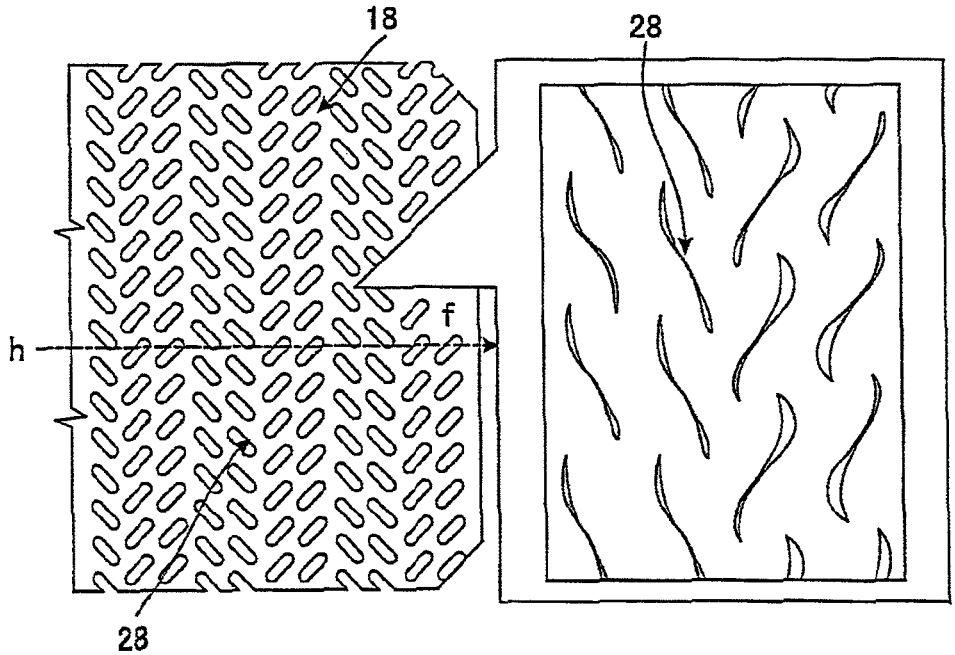
Figure 10:
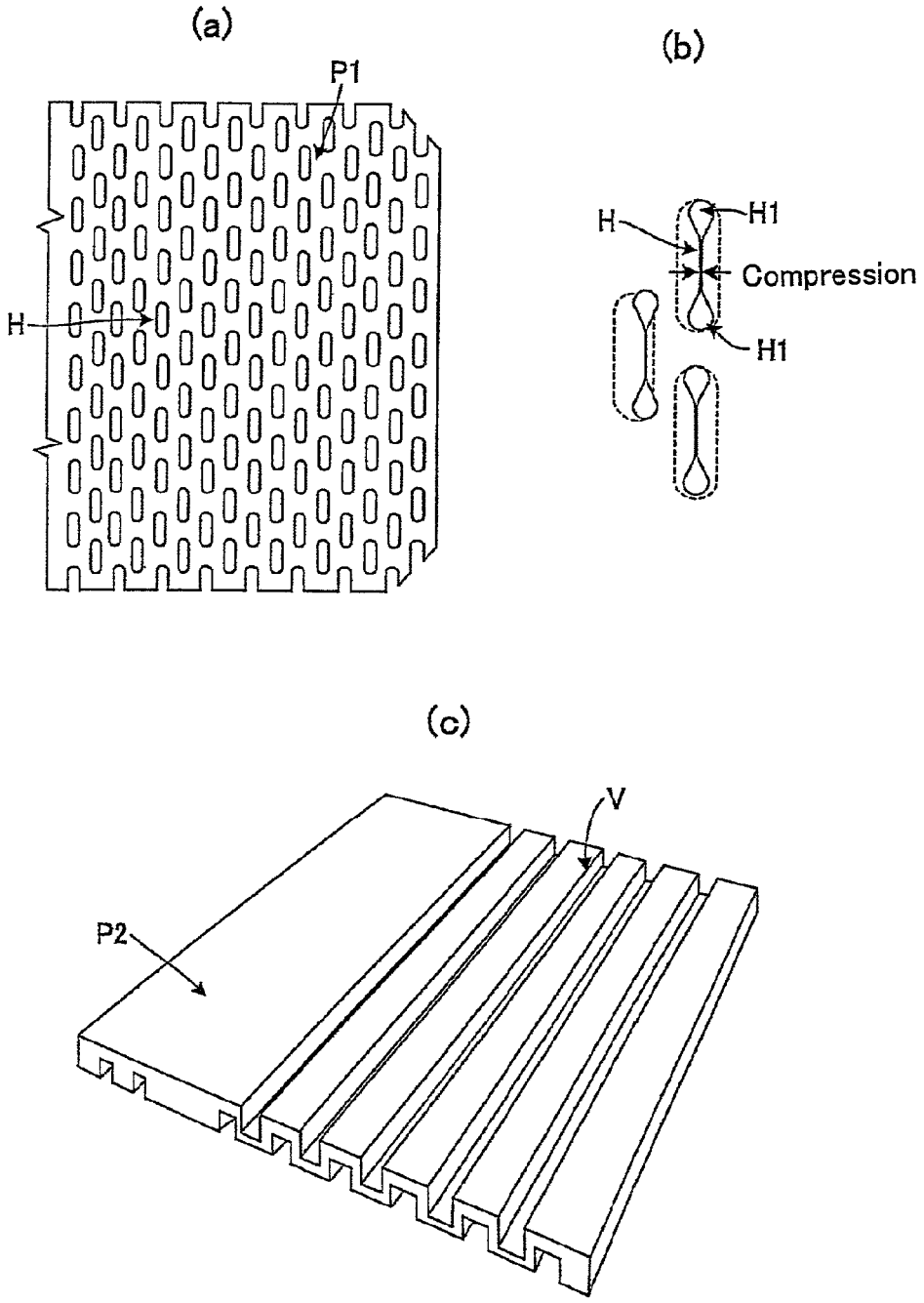
FIG. 10 An illustrative diagram showing a conventional mattress core, (a) and (b) illustrative diagrams of a mattress core formed with punched holes, (c) an illustrative diagram of a corrugated mattress core.

FIGS. 3(*a*) and 3(*b*) show a conventional mattress and mattress 10 of the embodiment by comparison. As shown in FIG. 3(*a*), in the conventional mattress, holes H of a linear shape are arranged in foot section P in a staggered layout with respect to the longitudinal direction with its linear shape oriented perpendicular to the longitudinal direction of the mattress. Further, each hole H is formed in an approximately elliptic shape with a circular arched part at both side ends as described above with FIG. 10(*a*).

Figure 4:
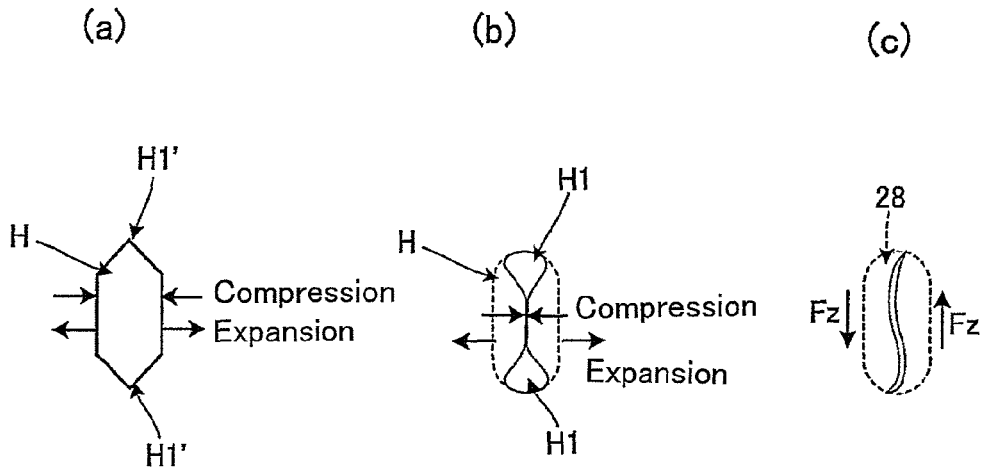
FIGS. 4 (*a*) and (*b*) illustrative diagrams of the hole of a mattress having a conventional configuration, (c) an illustrative diagram showing a deformed state of the hole of the mattress according to the embodiment.

In order to promote deformation at both ends of this hole H, granted that hole H is formed with angular corners (H1', H1') at both side ends as shown in FIG. 4(*a*), hole H becomes easily compressed (easy to deform). However, the side ends H1', H1' of hole H become prone to crack when the hole stretches. This is why both side ends of hole H is formed with circular arced parts H1, H1, as shown in FIG. 4(*b*). In this case, however, the hole is deformed such that only the long sides become close to each other while the side ends H1, H1 are less compressed. Accordingly, in the conventional mattress shown in FIG. 3(*a*) where the punched holes of a linear shape are arranged with its linear shape directed perpendicular to the longitudinal direction of the mattress core, the mattress is difficult to be compressed because no shearing stress can be generated when the mattress is contracted.

In contrast to this, in the mattress 10 of the embodiment, as shown in FIGS. 2 and 3(*b*), the plurality of holes 28 are formed with their linear shape inclined relative to the width direction of mattress 10. The plurality of holes 28 are arranged in such a staggered layout that the holes arrayed in a row in the width direction have the same inclination while the inclinations of the holes are made opposite on alternate rows along the longitudinal direction. In this way, the plurality of holes 28 are formed inclined relative to the width direction of mattress 10, so that even if hole 28 has the side ends as shown in FIG. 4(*c*) a couple of forces Fz, Fz act so as to make the opposing sides of the hole slid to opposite direction to each other, hence producing shearing stress around the periphery of hole 28. Since the aforementioned side ends present flexibility to the shearing stress, the holes 28 become easily deformed, hence foot section 18 is compressed smoothly.

Next, the relationship between the angle of hole 28 in mattress 10 according to the embodiment and the shearing stress on hole 28 will be described.

Figure 5:
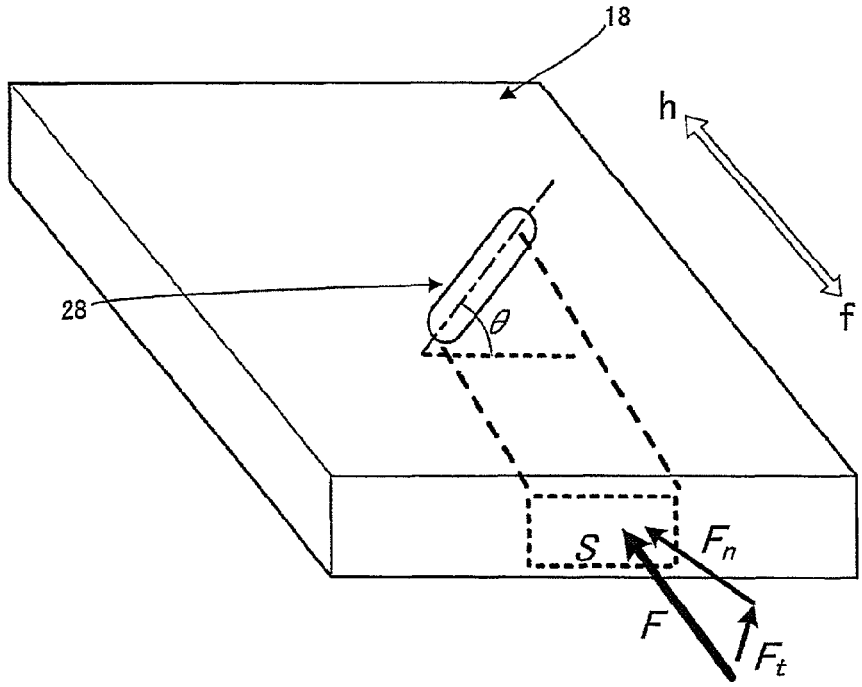
FIG. 5 A diagram for illustrating a shearing stress and the angle of the hole in the mattress according to the embodiment.

As shown in FIG. 5, when a compressing force F is acted on the punched hole 28 that is arranged at the angle θ relative to the width direction of the mattress 10 core, force Fn that acts in the width direction of punched hole 28 and force Ft that acts in the longitudinal direction of punched hole 28 are represented by the following expressions (1) and (2), respectively.

$$Fn=F\cos\theta \quad (1)$$

$$Ft=F\sin\theta \quad (2)$$

When S denotes the cross section of punched hole 28 across the endface on which the force is acted, a size Sθ of the cross section along the longitudinal direction of punched hole 28 is given by the following expression (3):—

$$S\theta=S/\cos\theta \quad (3)$$

Compressive stress σθ acting in the direction to crush punched hole 28 and shearing stress τθ acting in the direction along punched hole 28 can be represented by the following expressions (4) and (5), respectively.

$$\sigma\theta=Fn/S\theta=(F/S)\cdot\cos^2\theta \quad (4)$$

$$\tau\theta=Ft/S\theta=(F/S)\cdot\sin\theta\cos\theta \quad (5)$$

Accordingly, if punched hole 28 is arranged perpendicular to the length direction, $$\theta=0$$

$$\sigma 0=F/S$$

$$\tau 0=0$$

The greater $\theta(0\leq\theta\leq\pi/2)$, the smaller the compressive stress σθ.

On the other hand, because $d(\sin\theta\cdot\cos\theta)/d\theta=\cos^2\theta-\sin^2\theta=0$, the shearing stress τθ takes the maximum value τmax=F/2S at θ=π/4.

In this condition, the compressive stress σθ is also equal to F/2S.

The shearing stress τθ at θ=π/8 or 3π/8 takes a value of τθ=0.354F/S=0.71τmax. That is, the shearing stress equal to or greater than about 70% of the maximum value can be obtained within the range of $\pi/8\leq\theta\leq 3\pi/8$.

From the above, since in mattress 10 of the embodiment, punched holes 28 of a linear shape are formed with their linear shape oriented at an angle of π/4 relative to the width direction of the core as shown in FIG. 3(*b*), compressive stress acts on punched holes 28 most efficiently when the mattress is contracted, hence the mattress can be easily compressed.

Further, arrangement of punched holes 28 in a staggered layout makes it possible to transfer compressive stress uniformly to the entire mattress 10.

Moreover, punched holes 28 are arranged such that the inclinations of the linear shape of punched holes 28 relative to the longitudinal direction of mattress 10 is made different every other rows. Since punched hole 28 is prone to be compressed and deformed along the inclination of its linear shape, this alternate arrangement makes it possible to prevent mattress 10 from being compressed and deformed unevenly to one side with respect to the width direction.

Figure 6:
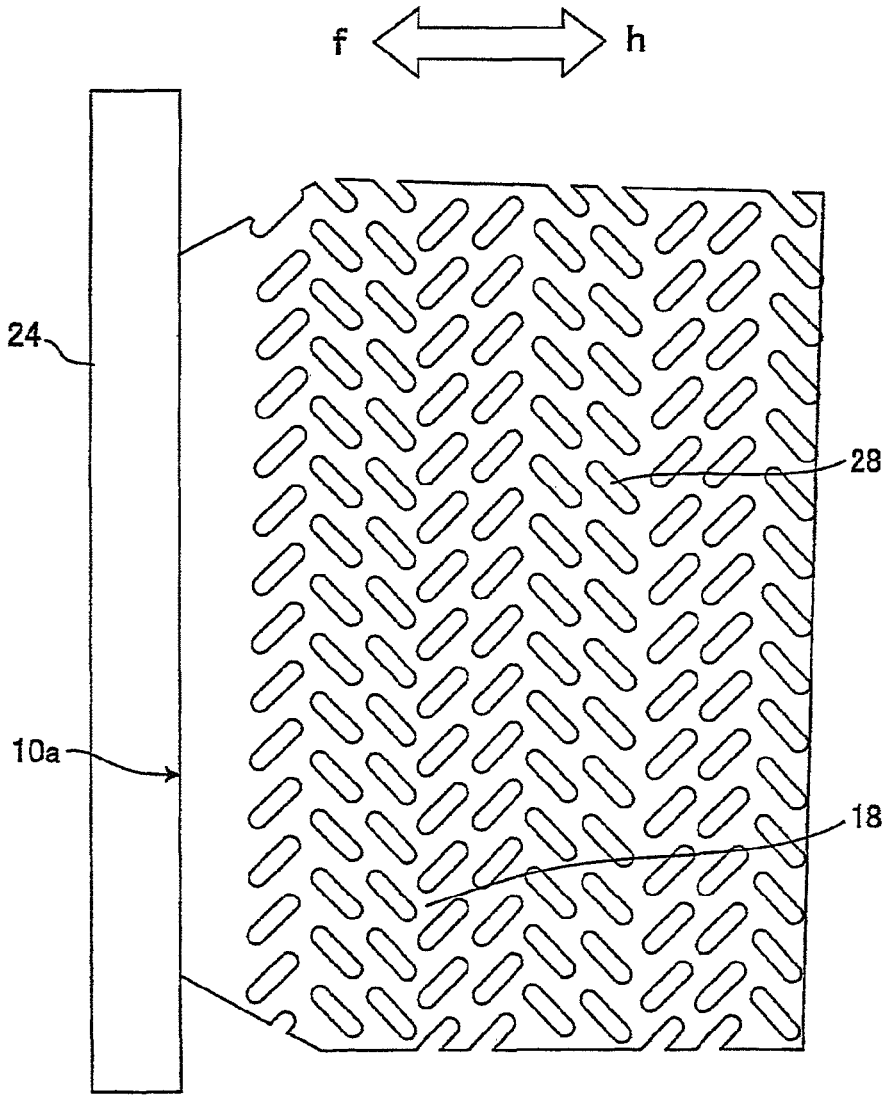
FIG. 6 An illustrative diagram showing the predeformed state of the foot section of the mattress depicted in FIG. 1.
Figure 7:
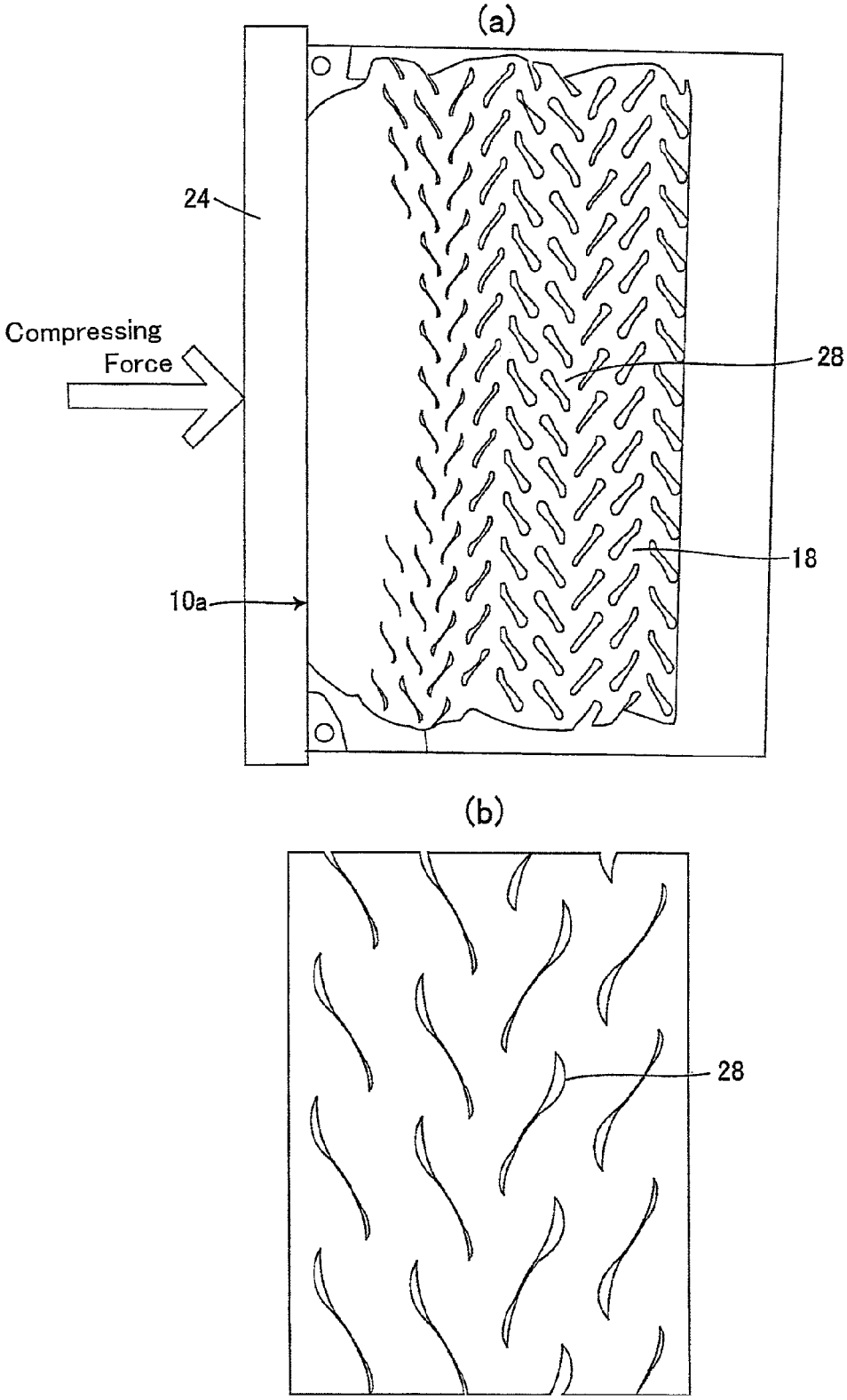
FIG. 7 An illustrative diagram showing the deformed state of the foot section of the mattress depicted in FIG. 1.

In the bed device of the embodiment, FIG. 6 shows a state when foot board 24 is initially positioned before shift. As the foot board 24 is moved to compress mattress 10 from the longitudinal end 10*a*, foot section 18 is compressed efficiently as shown in FIG. 7. As shown by enlargement in FIG. 7, holes 28 inclusive of the side ends thereof were positively deformed and it was confirmed that foot section 18 could be compressed and deformed uniformly.

Figure 8:
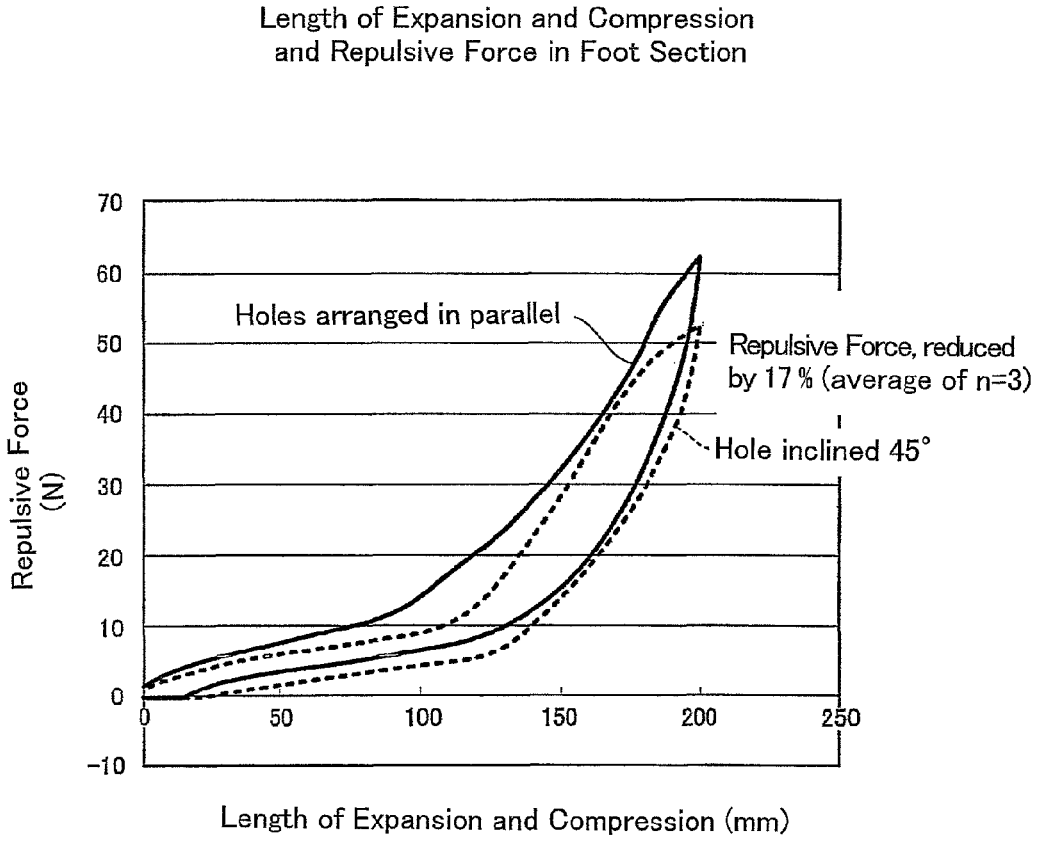
FIG. 8 An illustrative chart showing the relationship between the length of expansion and compression and the repulsive force for the conventional mattress and the mattress according to the embodiment.

Further, the relationships between the length of expansion and contraction and the repulsive force were measured (n=3) for the foot section of the conventional mattress in which punched holes of a linear shape are arranged in a conventional manner or perpendicular to the length direction as shown in FIG. 3(*a*) and for the foot section 18 of mattress 10 of the embodiment in which punched holes 28 of a linear shape are arranged at an angle of 45° relative to the width direction as shown in FIG. 3(*b*). The result of measurement shown in FIG. 8 was obtained. As shown in FIG. 8, the repulsive force was a little over 60 N(Newton) when the mattress was expanded/contracted (shortened) by about 200 mm, whereas in the embodiment, the repulsive force was a little over 50 N. That is, the repulsive force is diminished by 17% compared to the prior art, thus the validity of the present invention can be understood.

From the above, according to the mattress 10 of the embodiment, since a plurality of holes 28 including a linear shape inclined relative to the width direction of mattress 10 are penetrated at regular intervals in foot section 18 that is deformed by compression of mattress 10, shearing stress can be efficiently applied to the punched holes 28 in the mattress 10 so that the foot section can be easily contracted. In addition to this, since without the necessity of forming punched holes 28 in corrugation it is possible to form punched holes 28 of the same number and the same area as the conventional configuration, it is possible to provide mattress 10 that will neither increase the number of processing steps and nor deteriorate in strength compared to the conventional configuration.

Here, any embodied mode can be implemented with the technical scope of the invention. For example, the aforementioned plurality of holes 28 are formed in the linear shape, but as the foot section 18 of the mattress according to the second embodiment shown in FIG. 9(*a*), holes 28 of a cross shape that is inclined at an angle of 20° to 70° relative to the width direction of mattress 10 may be formed. Use of such cross-shaped holes 28 makes it possible to prevent the core of mattress 10 from being compressed and deformed unevenly in the direction of inclination of the linear shape such as the linear shape of the punched holes 28 in the embodiment, hence it is possible to compress and deform the mattress evenly with respect to the width direction, too.

Figure 9:
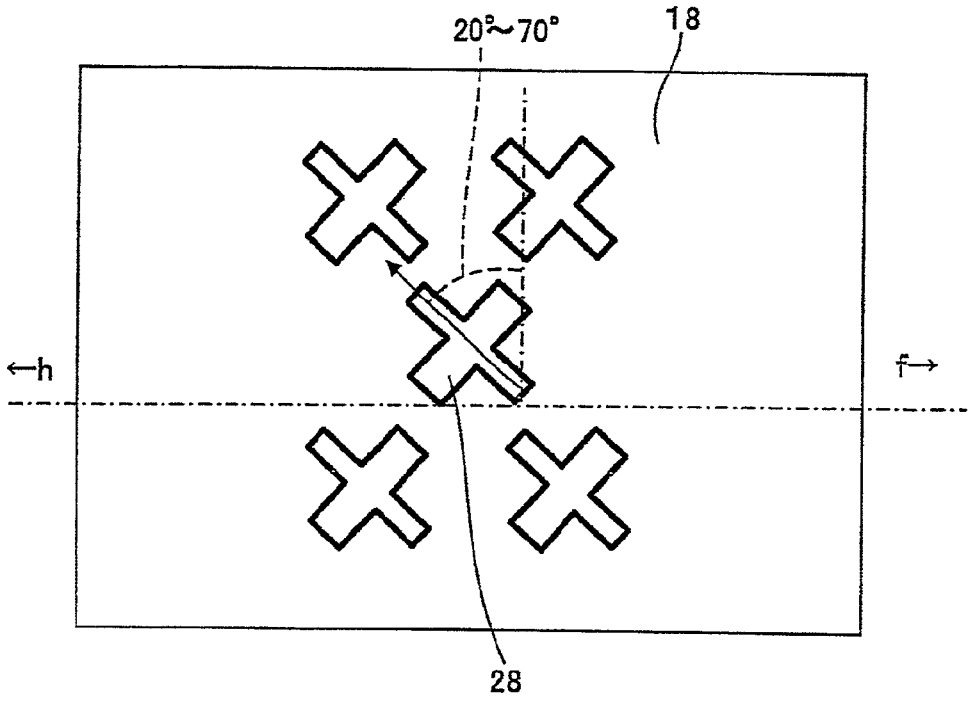
FIGS. 9 (*a*) and (*b*) illustrative diagrams respectively showing mattresses of the second and third embodiments of the present invention.
Figure 9:
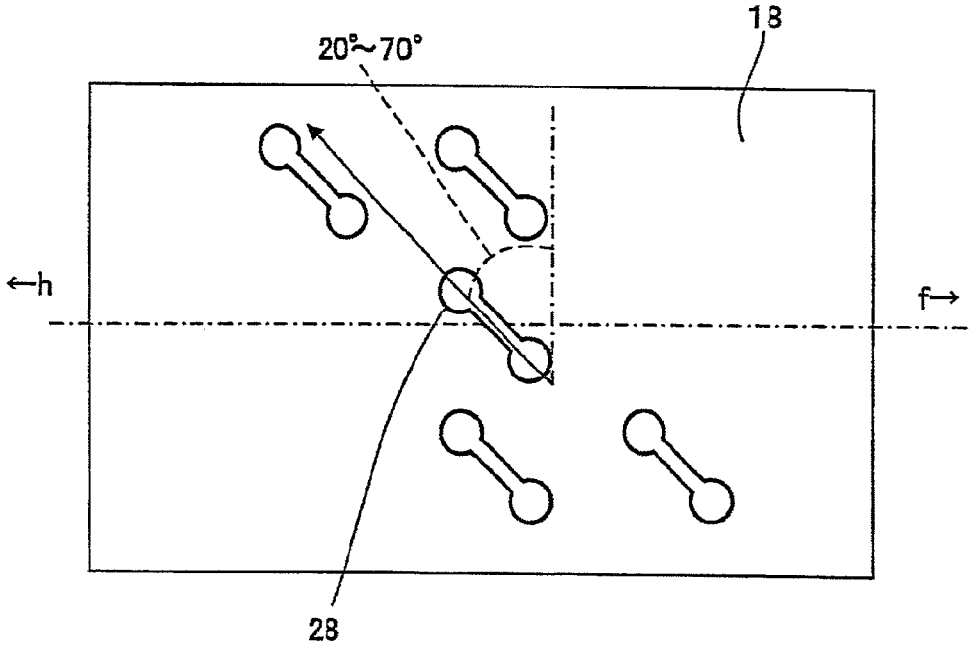

Further, though the above plurality of holes 28 have a linear shape with both of side edges circular arched, it is also possible to form holes 28 with an approximately dumbbell-like shape that is wider at side ends than in the center, as in foot section 18 of the mattress of the third embodiment shown in FIG. 9 (*b*). With this configuration, it is possible to prevent the core of mattress 10 from cracking due to holes 28 because the side part of hole 28 is large. The holes of the mattress of the present invention should not be limited to those being formed by punching. It is also possible to form a mattress by pouring foamed urethane into a die, or by using various other processing methods.

Other than the configuration of the embodiment, the bed device on which mattress 10 rests, may use various kinds of structures, such as a configuration in which, for example, foot section 18 is expanded and contracted by a linkage. The bed device may be one that has a function of raising and lowering and functions to expand and contract the mattress as a whole.

INDUSTRIAL APPLICABILITY

The mattress of the present invention can be used as a mattress for various kinds of bed devices for hospital and for sleeping.

DESCRIPTION OF REFERENCE NUMERALS

10 mattress
10*a* longitudinal end
12 bed device
14 bottom
14*a* expandable bottom
16 truck part
16*a* caster
16*b* elevating leg
18 foot section
20 main frame
22 expandable frame
24 foot board
26 head board
28 hole

The invention claimed is:

1. A mattress adapted to receive compression at one end in a longitudinal direction, comprising:

a plurality of holes including a linear shape inclined at an angle greater than zero degrees relative to a width direction of the mattress, the holes being penetratingly formed at regular intervals in a section to be deformed by the compression.

2. The mattress according to claim 1, wherein the plurality of holes are arranged in the mattress in a staggered layout when viewed from top.

3. The mattress according to claim 1, wherein the plurality of holes are formed such that an orientation of the linear shape is inclined at an angle of 20° to 70° relative to the width direction of the mattress.

4. The mattress according to claim 1, wherein the plurality of holes including the linear shape are formed as a cross shape.

5. The mattress according to claim 4, wherein the plurality of holes are formed with the cross shape inclined at an angle of 20° to 70° relative to the width direction of mattress.

6. The mattress according to claim 1, wherein the plurality of holes are formed to a dumbbell-like shape such that the ends of the linear shape are wider than a center.

7. The mattress according to claim 6, wherein the plurality of holes are formed such that an orientation of the shape is inclined at an angle of 20° to 70° relative to the width direction of the mattress.

8. A bed device having a bottom raising and lowering function an expandable and contractible function, on which the mattress according to claim 1 is set.

9. The mattress according to claim 2, wherein the plurality of holes are formed such that an orientation of the linear shape is inclined at an angle of 20° to 70° relative to the width direction of the mattress.

10. The mattress according to claim 2, wherein the plurality of holes including the linear shape are formed as a cross shape.

11. The mattress according to claim 2, wherein the plurality of holes are formed to a dumbbell-like shape such that the ends of the linear shape are wider than a center.

* * * * *